US008773342B2

(12) United States Patent
Lee

(10) Patent No.: US 8,773,342 B2
(45) Date of Patent: Jul. 8, 2014

(54) DISPLAY DEVICE AND STORAGE DRIVING CIRCUIT FOR DRIVING THE SAME

(75) Inventor: Baek-Woon Lee, Yongin-si (KR)

(73) Assignee: Samsung Display Co., Ltd., Yongin (KR)

( * ) Notice: Subject to any disclaimer, the term of this patent is extended or adjusted under 35 U.S.C. 154(b) by 1843 days.

(21) Appl. No.: 11/854,778

(22) Filed: Sep. 13, 2007

(65) Prior Publication Data

US 2008/0068322 A1 Mar. 20, 2008

(30) Foreign Application Priority Data

Sep. 14, 2006 (KR) ..... 10-2006-0089004

(51) Int. Cl.
*G09G 3/36* (2006.01)

(52) U.S. Cl.
USPC ..... 345/96

(58) Field of Classification Search
USPC ..... 345/87–100; 377/64–81
See application file for complete search history.

(56) References Cited

U.S. PATENT DOCUMENTS

2003/0016202 A1 * 1/2003 Edwards et al. ..... 345/98
2006/0208985 A1 * 9/2006 Hwang et al. ..... 345/92

FOREIGN PATENT DOCUMENTS

| | | |
|---|---|---|
| JP | 07-104246 | 4/1995 |
| JP | 2001-083943 | 3/2001 |
| JP | 2002-202762 | 7/2002 |
| JP | 2003-114651 | 4/2003 |
| JP | 2006-078588 | 3/2006 |
| JP | 2006-220947 | 8/2006 |

* cited by examiner

*Primary Examiner* — Dennis Joseph
(74) *Attorney, Agent, or Firm* — H.C. Park & Associates, PLC

(57) ABSTRACT

A display device includes a display panel, a gate driving circuit, a data driving circuit, and a storage driving circuit. The storage driving circuit includes a plurality of stages to apply a plurality of storage voltages, which are inverted in every frame, to the storage lines, respectively. A $k^{th}$ stage of the stages includes a counter charging part, a boosting part and a holding part. The counter charging part applies a first driving voltage to a $k^{th}$ storage line based on a $k^{th}$ gate signal. The boosting part applies a second driving voltage to the $k^{th}$ storage line based on a $(k+2)^{th}$ gate signal. The holding part applies a storage voltage to the $k^{th}$ storage line based on a $(k+1)^{th}$ gate signal during one frame. The level of the storage voltage corresponds to the second driving voltage.

18 Claims, 5 Drawing Sheets

400

DISPLAY DEVICE AND STORAGE DRIVING CIRCUIT FOR DRIVING THE SAME

CROSS-REFERENCE TO RELATED APPLICATION

The present application claims priority from and the benefit of Korean Patent Application No. 10-2006-0089004, filed on Sep. 14, 2006, which is hereby incorporated by reference for all purposes as if fully set forth herein.

BACKGROUND OF THE INVENTION

1. Field of the Invention

The present invention relates to a display device. More particularly, the present invention relates to a display device and a storage driving circuit for driving the display device.

2. Discussion of the Background

A liquid crystal display (LCD) device, in general, includes an array substrate having a pixel electrode, an opposite substrate having a common electrode, and a liquid crystal layer interposed between the array substrate and the opposite substrate. The liquid crystal layer has liquid crystals having dielectric anisotropy. The alignment of the liquid crystals of the liquid crystal layer varies in response to an electric field applied thereto, changing the light transmittance of the liquid crystal layer and displaying an image.

LCD devices have various advantageous characteristics, such as a thin thickness, low power consumption, high resolution, etc., and thus, LCD devices have been used in the electronic device field in notebook computers, monitors, etc. Also, mobile communication devices include LCD devices that display information, as well as still images, moving images, broadcasts, etc.

However, the power consumption of LCD devices has increased as the resolution of the LCD devices has increased. Also, LCD devices are required to have faster response speeds in order to display moving images.

SUMMARY OF THE INVENTION

The present invention provides a display device that may be capable of decreasing power consumption and increasing response speed.

The present invention also provides a storage driving circuit for driving the display device.

Additional features of the invention will be set forth in the description which follows, and in part will be apparent from the description, or may be learned by practice of the invention.

The present invention discloses a display device including a display panel, a gate driving circuit, a data driving circuit, and a storage driving circuit. The display panel includes a plurality of gate lines, a plurality of data lines, and a plurality of storage lines extending in a direction substantially parallel to the gate lines. The gate driving circuit applies a plurality of gate signals to the gate lines, respectively. The data driving circuit applies a plurality of data signals to the data lines, respectively. The storage driving circuit includes a plurality of stages to apply a plurality of storage voltages, which are inverted in every frame, to the storage lines, respectively. A $k^{th}$ stage of the stages includes a counter charging part, a boosting part, and a holding part. The counter charging part applies a first driving voltage to a $k^{th}$ storage line based on a $k^{th}$ gate signal. The boosting part applies a second driving voltage to the $k^{th}$ storage line based on a $(k+2)^{th}$ gate signal. The holding part applies a storage voltage to the $k^{th}$ storage line based on a $(k+1)^{th}$ gate signal during one frame. The level of the storage voltage corresponds to the second driving voltage.

The present invention also discloses a storage driving circuit integrated on a display panel including a plurality of gate lines receiving a plurality of gate signals, a plurality of data lines, and a plurality of storage lines extending in a direction substantially parallel to the gate lines. The storage driving circuit includes a plurality of stages to apply a plurality of storage voltages, which are inverted in every frame, to the storage lines, respectively. A $k^{th}$ stage of the stages includes a counter charging part to apply a first driving voltage to a $k^{th}$ storage line based on a $k^{th}$ gate signal, a boosting part to apply a second driving voltage to the $k^{th}$ storage line based on a $(k+2)^{th}$ gate signal, and a holding part to apply a storage voltage to the $k^{th}$ storage line based on a $(k+1)^{th}$ gate signal during one frame. The level of the storage voltage corresponds to the second driving voltage, wherein 'k' is a natural number.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
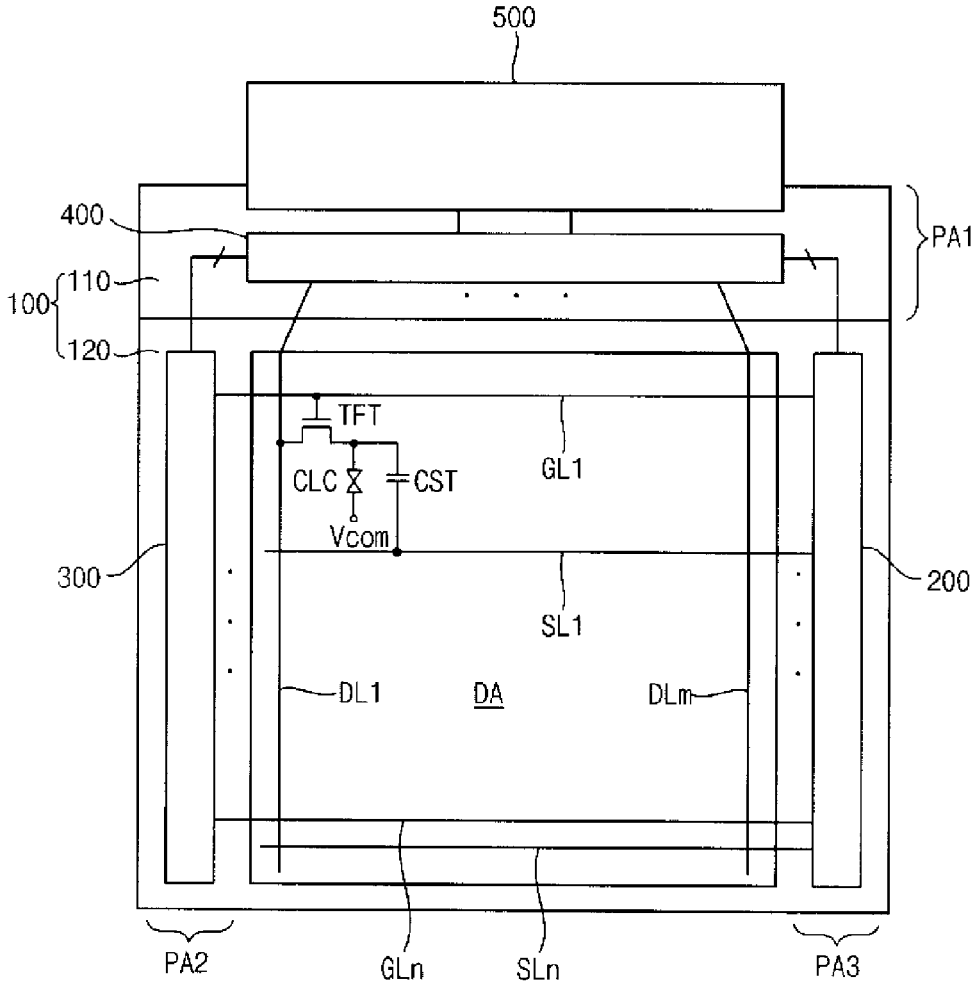
FIG. 1 is a plan view showing a display device in accordance with an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, exemplary embodiments of the present invention will be described in detail with reference to the accompanying drawings.

FIG. 1 is a plan view showing a display device in accordance with an exemplary embodiment of the present invention.

Referring to FIG. 1, the display device includes a flexible circuit board 500, a display panel 100, a driving part 400, a gate driving circuit 300, and a storage driving circuit 200.

The flexible circuit board 500 receives synchronization signals and an image data signal to transmit to the driving part 400. The synchronization signals include a vertical synchronization signal Vsync, a horizontal synchronization signal Hsync, a main clock signal MCLK, and a data enable signal DE.

The display panel 100 includes an array substrate 110, an opposite substrate 120, and a liquid crystal layer (not shown). The opposite substrate 120 may be a color filter substrate. The liquid crystal layer is interposed between the array substrate 110 and the opposite substrate 120. A display region DA, a first peripheral region PA1, a second peripheral region PA2, and a third peripheral region PA3 are defined on the display panel 100. The first, second, and third peripheral regions PA1, PA2, and PA3 surround the display region DA.

A plurality of pixel parts is defined in the display region DA. The array substrate 110 includes a plurality of gate lines GL1, . . . , GLn and a plurality of data lines DL1, . . . , DLm that extend in a different direction than the gate lines GL1, . . . , GLn. A plurality of storage lines SL1, . . . , SLn that extend in substantially the same direction as the gate lines GL1, . . . , GLn is formed in the display region DA. The storage lines SL1, . . . , SLn overlap pixel parts aligned in a horizontal direction that is substantially parallel to the gate lines GL1, . . . , GLn. Each pixel part includes a thin-film transistor TFT that is a switching element, a liquid crystal capacitor CLC, and a storage capacitor CST.

The TFT is formed in the array substrate 110, and a gate electrode and a source electrode of the TFT are connected to one of the gate lines GL1, . . . , GLn and one of the data lines DL1, . . . , DLm, respectively. The liquid crystal capacitor CLC is formed in the array substrate 110 and is defined by a pixel electrode and a common electrode overlapping the pixel electrode. The pixel electrode is connected to a drain electrode of the TFT. A storage capacitor CST is defined by each storage line SL1, . . . , SLn and the pixel electrode.

The driving part 400 is formed in the first peripheral region PA1 in which first end portions of the data lines DL1, . . . , DLm are disposed. The driving part 400 may include a driving chip mounted in the first peripheral region PA1. The driving part 400 outputs a data voltage corresponding to an image data signal DATA to each data line DL1, . . . , DLm. Also, the driving part 400 applies gate control signals and a gate driving voltage to drive the gate driving circuit 300 and storage driving voltages to drive the storage driving circuit 200.

The gate driving circuit 300 is formed in the second peripheral region PA2 in which first end portions of the gate lines GL1, . . . , GLn are disposed. The gate driving circuit 300 may be directly integrated on the array substrate 110 as an integrated circuit. The gate driving circuit 300 sequentially outputs gate signals to the gate lines GL1, . . . , GLn based on the gate control signals and the gate driving voltage that are from the driving part 400. The gate control signals include a vertical start signal STV, a first clock signal CK, and a second clock signal CKB. The gate driving voltage includes a gate-on voltage VDD and a gate-off voltage VSS.

The storage driving circuit 200 is formed in the third peripheral region PA3 in which second end portions of the gate lines GL1, . . . , GLn are disposed. The storage driving circuit 200 may be directly integrated on the array substrate 110 as an integrated circuit. The storage driving circuit 200 outputs storage voltages to the storage lines SL1, . . . , SLn based on the storage driving voltages that are from the driving part 400. The levels of the storage voltages are inverted in every frame. The levels of the storage voltages applied to the storage lines SL1, . . . , SLn correspond to the polarities of the data voltages. The level of each storage voltage is inverted after the data voltage is charged in each pixel part. For example, when a data voltage having positive polarity (+) is charged in a pixel part, the level of the storage voltage is low when the pixel part is being charged and is high after the charging of the pixel part is finished.

Figure 2:
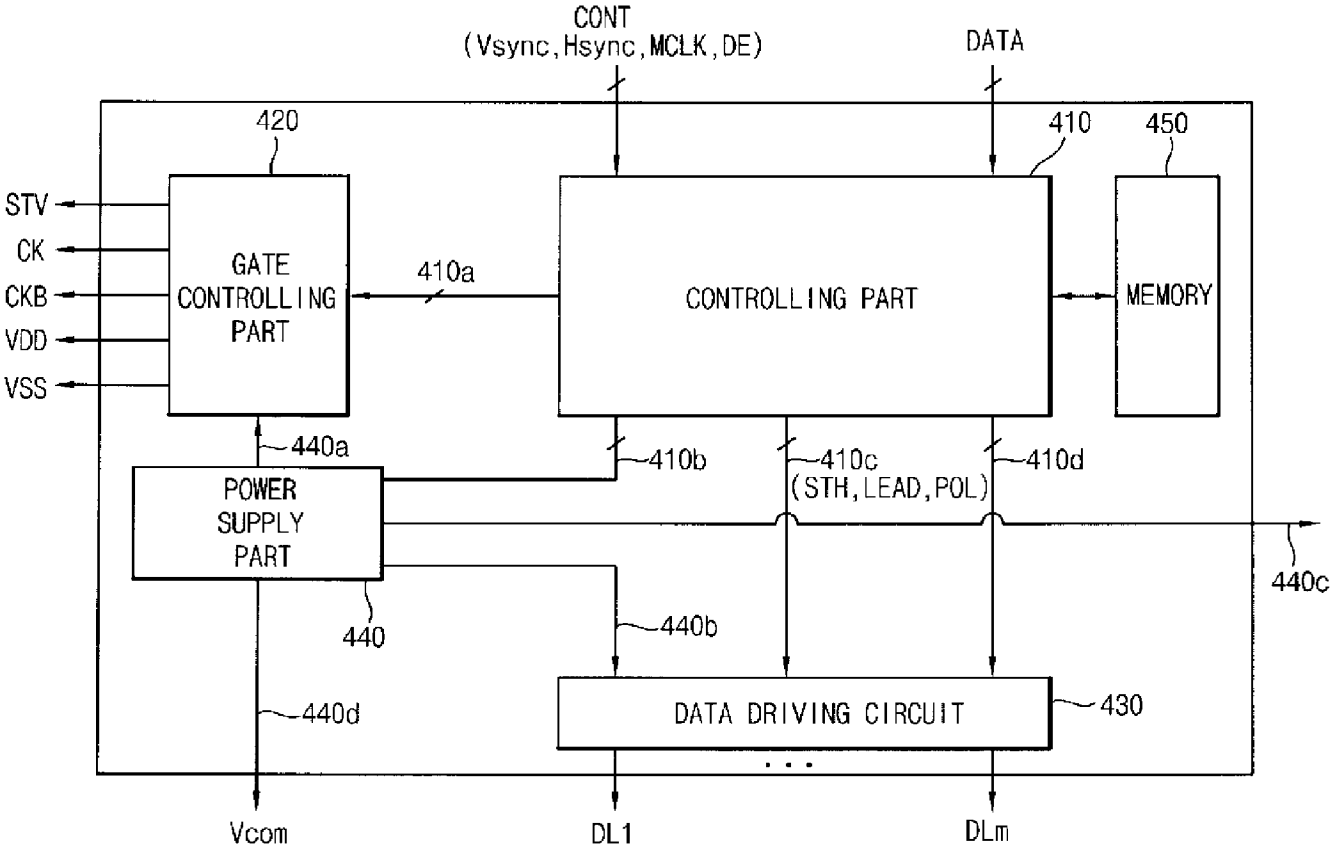
FIG. 2 is a block diagram showing a driving part shown in FIG. 1.

FIG. 2 is a block diagram showing a driving part shown in FIG. 1.

Referring to FIG. 1 and FIG. 2, the driving part 400 includes a controlling part 410, a gate controlling part 420, a data driving circuit 430, a power supply part 440, and a memory 450.

The controlling part 410 receives the synchronization signals CONT and the data signals DATA. The synchronization signals CONT include the vertical synchronization signal Vsync, the horizontal synchronization signal Hsync, the main clock signal MCLK, and the data enable signal DE. The controlling part 410 stores the data signals DATA based on the synchronization signals CONT, and applies gate control signals 410*a* to the gate controlling part 420. Also, the controlling part 410 applies data control signals 410*c* to the data driving circuit 430. The gate control signals 410*a* include the vertical start signal STV, a first clock signal CK, and a second clock signal CKB. The data control signals 410*c* include a horizontal start signal STH, a load signal LEAD, and an inversion signal POL.

In addition, the controlling part 410 reads the data signals DATA stored in the memory 450 to apply the data signals DATA to the data driving circuit 430, and applies voltage control signals 410*b* to the power supply part 440. The voltage control signals 410*b* include the main clock signal MCLK and the inversion signal POL.

The memory 450 temporarily stores the data signal DATA. For example, the memory 450 stores the data signal DATA for a unit frame or a unit line. The controlling part 410 controls the memory 450 to write or read the data signal DATA.

The gate controlling part 420 applies the gate control signals 410*a* from the controlling part 410 and the gate driving voltages 440*a* from the power supply part 440 to the gate driving circuit 300.

The data driving circuit 430 receives reference gamma voltages 440*b* from the power supply part 440 and receives data control signals 410*c* and data signals 410*d* from the controlling part 410. The data driving circuit 430 changes the data signals 410*d* into data voltages of an analog type based on the reference gamma voltages 440*b*. The data voltages are applied to the data lines DL1, . . . , DLm, respectively. The data driving circuit 430 may operate through an inversion driving method. In the inversion driving method, the data driving circuit 430 inverts the levels of the data voltages with respect to a common voltage Vcom, which may prevent deterioration of the liquid crystals. For example, the data driving circuit 430 inverts the levels of the data voltages between positive polarity and negative polarity with respect to the common voltage Vcom in every line.

The power supply part 440 generates the driving voltages based on the voltage control signals 410*b* to drive the display panel 100. The voltage control signals 410*b* are received from the controlling part 410. For example, the power supply part 440 applies the gate driving voltage 440*a* including the gate-on voltage VDD and the gate-off voltage VSS to the gate controlling part 420 and applies the reference gamma voltages 440*b* for the data voltages to the data driving circuit 430. Also, the power supply part 440 generates the common voltage Vcom to apply the common voltage Vcom to the common electrode formed in the opposite substrate 120 and applies the storage driving voltages 440*c* to the storage driving circuit 200.

The storage driving voltages 440*c* drive the storage driving circuit 200 and include a first driving voltage, a second driving voltage, a first storage voltage, a second storage voltage, a first switching voltage, and a second switching voltage.

Hereinafter, the storage driving circuit 200 will be explained in detail with reference to FIG. 3 and FIG. 4.

Figure 3:
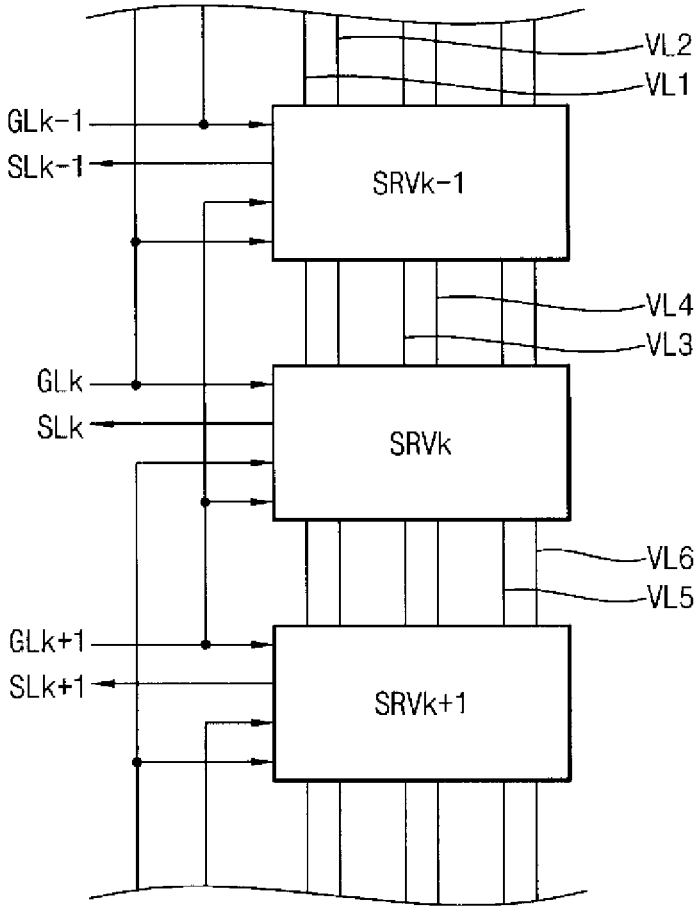
FIG. 3 is a block diagram showing a storage driving circuit in accordance with an exemplary embodiment of the present invention.

FIG. 3 is a block diagram showing a storage driving circuit in accordance with an exemplary embodiment of the present invention. FIG. 4 is a circuit diagram showing a stage shown in FIG. 3.

Figure 4:
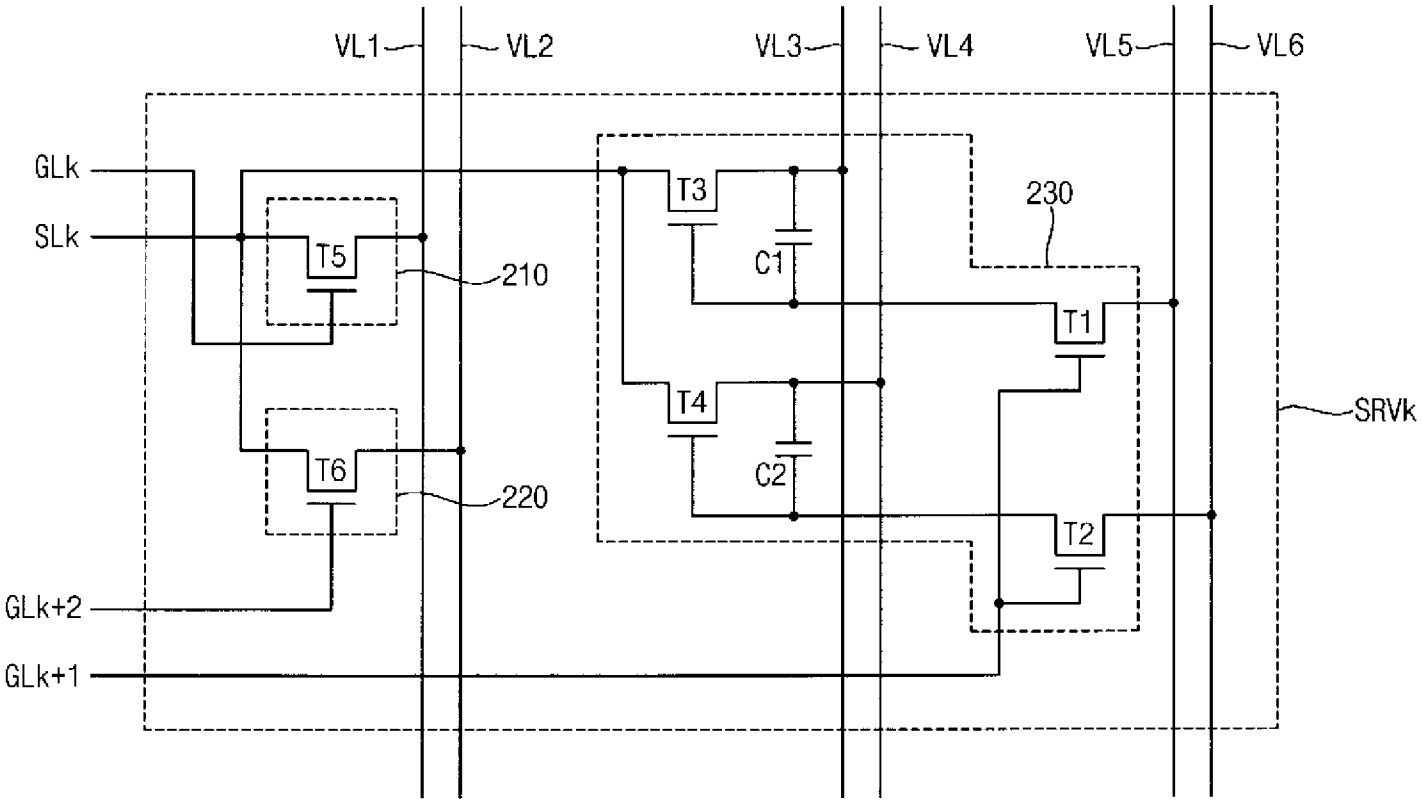
FIG. 4 is a circuit diagram showing a stage shown in FIG. 3.

Referring to FIG. 3 and FIG. 4, the storage driving circuit 200 includes a plurality of stages SRV corresponding to a plurality of storage lines SL1, . . . , SLn, respectively. The storage driving circuit 200 may further include a plurality of voltage lines VL1, . . . , VL6 that apply storage driving voltages 440*c* to the stages SRV.

The voltage lines VL1, . . . , VL6 include a first voltage line VL1, a second voltage line VL2, a third voltage line VL3, a fourth voltage line VL4, a fifth voltage line VL5, and a sixth voltage line VL6. The first and second voltage lines VL1 and VL2 receive a first driving voltage and a second driving voltage, respectively. The third and fourth voltage lines VL3 and VL4 receive a first storage voltage and a second storage voltage, respectively. The fifth and sixth voltage lines VL5 and VL6 receive a first switching voltage and a second switching voltage, respectively.

The stages SRV may all be substantially the same, and thus a $k^{th}$ stage SRVk will be explained as follows, wherein k is a natural number smaller than n.

The $k^{th}$ stage SRVk receives gate signals from a $k^{th}$ gate line GLk, a $(k+1)^{th}$ gate line GLK+1, and a $(k+2)^{th}$ gate line GLk+2, and receives the storage driving voltages 440*c* from the voltage lines VL1, . . . , VL6. Thus, the $k^{th}$ stage SRVk applies the storage voltages to the $k^{th}$ storage line SLk. For example, the $k^{th}$ stage SRVk is synchronized with the $k^{th}$ gate signal, the $(k+1)^{th}$ gate signal, and the $(k+2)^{th}$ gate signal to apply the storage voltages corresponding to the first and second driving voltages, the first and second storage voltages, and the first and second switching voltages to the $k^{th}$ storage line SLk.

For example, in FIG. 4, the $k^{th}$ stage SRVk includes a counter charging part 210, a boosting part 220, and a holding part 230.

The counter charging part 210 includes a fifth switching element T5 that has an input terminal connected to the first voltage line VL1, a control terminal connected to a $k^{th}$ gate line GLk, and an output terminal connected to a $k^{th}$ storage line SLk. The counter charging part 210 applies the first driving voltage from the first voltage line VL1 to the $k^{th}$ storage line SLk based on the $k^{th}$ gate signal.

The boosting part 220 includes a sixth switching element T6 that includes an input terminal connected to the second voltage line VL2, a control terminal connected to the $(k+2)^{th}$ gate line GLk+2, and an output terminal connected to the output terminal of the fifth switching element T5 and the $k^{th}$ storage line SLk. The boosting part 220 applies the second driving voltage, which is at a different level than the first driving voltage, to the $k^{th}$ storage line SLk based on the $(k+2)^{th}$ gate signal.

The holding part 230 includes a first switching element T1, a second switching element T2, a third switching element T3, a fourth switching element T4, a first capacitor C1, and a second capacitor C2. The first switching element T1 includes an input terminal connected to the fifth voltage line VL5, and a control terminal connected to the $(k+1)^{th}$ gate line GLk+1. The second switching element T2 includes an input terminal connected to the sixth voltage line VL6 and a control terminal connected to the control terminal of the first switching element T1 and the $(k+1)^{th}$ gate line GLk+1. The third switching element T3 includes an input terminal connected to the third voltage line VL3, a control terminal connected to the output terminal of the first switching element T1, and an output terminal connected to the $k^{th}$ storage line SLk. The fourth switching element T4 includes an input terminal connected to the fourth voltage line VL4, a control terminal connected to the output terminal of the second switching element T2, and an output terminal connected to the output terminal of the third switching element T3 and the $k^{th}$ storage line SLk. The first capacitor C1 is connected to the control terminal and the input terminal of the third switching element T3. The second capacitor C2 is connected to the control terminal and the input terminal of the fourth switching element T4.

The holding part 230 applies a storing voltage (for example, a first storing voltage or a second storing voltage) to the $k^{th}$ storage line SLk during one frame based on the $(k+1)^{th}$ gate signal. The storing voltage generated from the holding part 230 corresponds to the level of the second driving voltage output from the boosting part 220.

The polarity of the data voltage is inverted in every row of pixel parts. Also, the input terminals of the third and fourth switching elements T3 and T4 are alternately connected to the third and fourth voltage lines VL3 and VL4 in every row of the pixel parts. For example, the input terminals of the third and fourth switching elements T3 and T4 of odd-numbered stages may be connected to the third and fourth voltage lines VL3 and VL4, respectively, and the input terminals of the third and fourth switching elements T3 and T4 of even-numbered stages may be connected to the fourth and third voltage lines VL4 and VL3, respectively. In addition, the input terminals of the first and second switching elements T1 and T2 of odd-numbered stages may be connected to the fifth and sixth voltage lines VL5 and VL6, respectively, and the input terminals of the first and second switching elements T1 and T2 of even-numbered stages may be connected to the fifth and sixth voltage lines VL5 and VL6, respectively.

Figure 5:
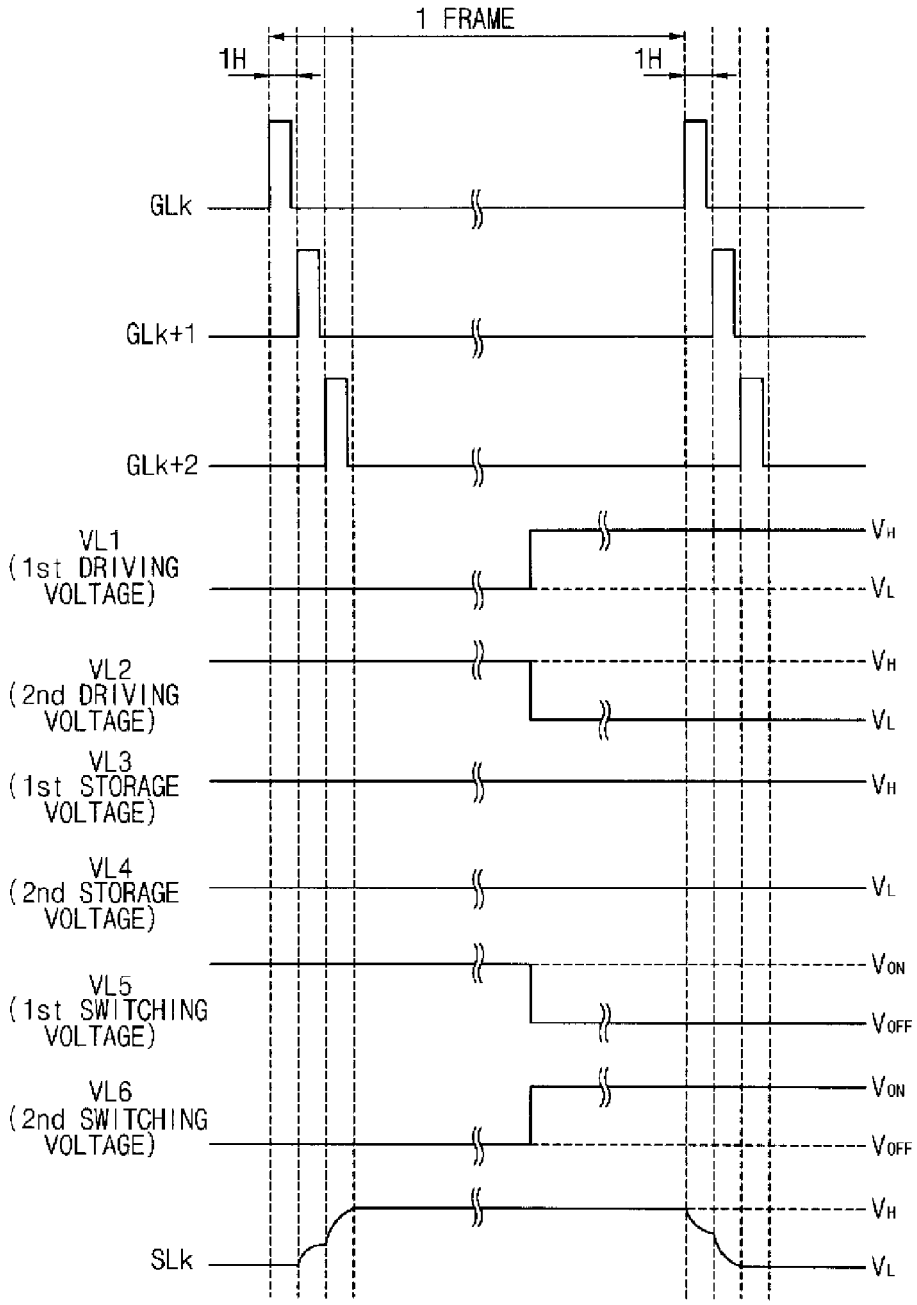
FIG. 5 is a waveform diagram showing an operation of the stage shown in FIG. 4.

FIG. 5 is a waveform diagram showing the operation of the stage shown in FIG. 4.

In FIG. 5, the data voltage has positive polarity.

Referring to FIG. 4 and FIG. 5, the first and second driving voltages are inverted in every frame. For example, the first and second driving voltages are inverted between a first level $V_H$ (for example, a high level) and a second level $V_L$ (for example, a low level) that is lower than the first level $V_H$. The second driving voltage has a phase opposite that of the first driving voltage. For example, when the data voltage has positive polarity (+), the first driving voltage is at the first level $V_H$ and the second driving voltage is at the second level $V_L$.

The first and second storage voltages are not inverted, and may have constant levels. For example, the first storage voltage may be maintained at the first level $V_H$, and the second storage voltage may be maintained at the second level $V_L$.

The first and second switching voltages are inverted in every frame. For example, the first and second switching voltages are inverted between a turn-on level $V_{ON}$ and a turn-off level $V_{OFF}$ in every frame, and have opposite levels to each other. For example, when the data voltage has the positive polarity (+), the first switching voltage has the turn-on level $V_{ON}$, and the second switching voltage has the turn-off level $V_{OFF}$. The turn-on level $V_{ON}$ is a level of a voltage to turn on the third and fourth switching elements T3 and T4, and the turn-off level $V_{OFF}$ is a level of a voltage to turn off the third and fourth switching elements T3 and T4.

The first and second driving voltages and the first and second switching voltages are inverted during a blank period of the data voltage before the $k^{th}$ gate signal is applied to the $k^{th}$ gate line GLk.

Referring again to FIG. 1 and FIG. 5, the operation of the $k^{th}$ stage SRVk will be explained with reference to the waveform diagram. When the $k^{th}$ gate signal is at the high level $V_H$, the fifth switching element T5 is turned on so that the first driving voltage at the second level $V_L$ is applied to the $k^{th}$ storage line SLk. When the $k^{th}$ gate signal is at the high level, the TFTs connected to the $k^{th}$ gate line GLk are turned on so that pixel electrodes are charged by the data voltages having positive polarity (+). For example, the $k^{th}$ storage line SLk is at the second level $V_L$ when the pixel electrodes are being charged by the data voltages.

When the $(k+1)^{th}$ gate signal has the high level, the first and second switching elements T1 and T2 are turned on so that the first switching voltage of the turn-on level $V_{ON}$ is applied to the control terminal of the third switching element T3 through the first switching element T1 and the second switching voltage of the turn-off level $V_{OFF}$ is applied to the control terminal of the fourth switching element T4 through the second switching element T2. Thus, the fourth switching element T4 is turned off, and the third switching element T3 is turned on so that the first storage voltage at the first level $V_H$ is applied to the $k^{th}$ storage line SLk. As explained below, the level of the voltage applied to the $k^{th}$ storage line SLk gradually increases to the first level $V_H$.

The first and second switching voltages that are applied to the control terminals of the third and fourth switching elements T3 and T4 are charged in the first and second capacitors C1 and C2, respectively, so that the third and fourth switching elements T3 and T4 are turned on/off during the frame. For example, the third switching element T3 may be turned on by the first capacitor C1 charged by the first switching voltage, so that the first storage voltage may be applied to the $k^{th}$ storage line SLk during the frame.

When the $(k+2)^{th}$ gate signal has the high level, the sixth switching element T6 is turned on so that the second driving voltage at the first level $V_H$ is applied to the $k^{th}$ storage line SLk.

Then, all of the switching elements except for the third switching element T3 are turned off, and the third switching element T3 maintains an on state using the first capacitor C1. Thus, the first storage voltage of the first level $V_H$ is applied to the $k^{th}$ storage line SLk, so that the $k^{th}$ storage line SLk maintains the first level $V_H$.

The fifth and sixth switching elements T5 and T6 control functions of the counter charging part 210 and the boosting part 220, respectively, which receive a current of large amount, so the operation of the holding part 230 may be stabilized although a capacity of each of the first, second, third, and fourth switching elements T1, T2, T3, and T4 of the holding part 230 may be about one-tenth of that of each of the fifth and sixth switching elements T5 and T6.

Thus, when the first storage voltage of the first level $V_H$ is applied to the third switching element T3, the level of the voltage applied to the $k^{th}$ storage line SLk gradually changes to the first level $V_H$. The level of the voltage applied to the $k^{th}$ storage line SLk is equal to the first level $V_H$ after the second driving voltage is applied via the sixth switching element T6. Also, the ratio of width/length of the channel region of the third switching element T3, which is turned on for a long time, is decreased, so that power consumption of the storage driving circuit may be decreased.

The polarity of the data voltage is inverted to have negative polarity during a next frame, and the first and second driving voltages and the first and second switching voltages are inverted. Thus, the level of the $k^{th}$ storage line SLk is inverted. For example, the level of the voltage applied to the $k^{th}$ storage line is synchronized with the $k^{th}$ gate signal to be at the first level $V_H$. Then, the level of the $k^{th}$ storage line is synchronized with the $(k+1)^{th}$ gate signal to gradually change from the first level $V_H$ to the second level $V_L$, and then synchronized with the $(k+2)^{th}$ gate signal to change to the second level $V_L$. The second storage voltage that is applied to the fourth switching T4 element maintains the level of the $k^{th}$ storage line SLk.

When the data voltage has positive polarity (+), the storage voltage at the low level $V_L$ is applied to the storage line SL when the data voltage is being charged and the storage voltage at the high level $V_H$ is applied to the storage line SL after the charging of the data voltage is finished. Thus, the level of the voltage applied to the pixel electrode is boosted, so that the response speed may be increased. Also, a voltage difference between the pixel electrode and a common electrode may be increased by the boosting of the pixel electrode, so the range of a gray scale voltage may be increased, thereby increasing luminance.

According to exemplary embodiments of the present invention, the level of a storage line may be inverted after a data voltage is charged, so the level of a pixel electrode may be boosted. Thus, the response speed of liquid crystals may be increased, and the range of a gray scale voltage may be increased, thereby increasing luminance. In addition, the storage line is not floated after the inversion, and a voltage having a constant level is applied to the storage line. Thus, horizontal crosstalk caused by variations in the level of a voltage applied to a liquid crystal capacitor may be prevented, even when the capacitance of the liquid crystal capacitor is changed.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

a display panel comprising a plurality of gate lines, a plurality of data lines, and a plurality of storage lines, the storage lines extending in a direction substantially parallel to the gate lines;

a gate driving circuit to apply a plurality of gate signals to the gate lines, respectively;

a data driving circuit to apply a plurality of data voltages to the data lines, respectively; and a storage driving circuit comprising a plurality of stages to apply a plurality of storage voltages, which are inverted in every frame, to the storage lines, respectively, a $k^{th}$ stage of the stages comprising:

a first voltage application unit to apply a first driving voltage to a $k^{th}$ storage line based on a $k^{th}$ gate signal;

a second voltage application unit to apply a second driving voltage to the $k^{th}$ storage line based on a $(k+2)^{th}$ gate signal; and a third voltage application unit to apply a storage voltage to the $k^{th}$ storage line based on a $(k+1)^{th}$ gate signal, wherein 'k' is a natural number, wherein the third voltage application unit comprises:

a first switching element to output a first switching voltage based on the $(k+1)^{th}$ gate signal;

a second switching element to output a second switching voltage based on the $(k+1)^{th}$ gate signal;

a third switching element to output a first storage voltage to the $k^{th}$ storage line based on the first switching voltage;

a fourth switching element to output a second storage voltage to the $k^{th}$ storage line based on the second switching voltage;

a first capacitor to be charged with the first switching voltage to maintain an on/off state of the third switching element during the one frame; and a second capacitor to be charged with the second switching voltage to maintain an on/off state of the fourth switching element during the one frame.

2. The display device of claim 1, wherein the data voltage is inverted in every row of a plurality of pixel parts and in every frame.

3. The display device of claim 1, wherein the storage driving circuit is integrated on the display panel as an integrated circuit.

4. The storage driving circuit of claim 1, wherein the level of the storage voltage corresponds to the second driving voltage.

5. A display device, comprising:

a display panel comprising a plurality of gate lines, a plurality of data lines, and a plurality of storage lines, the storage lines extending in a direction substantially parallel to the gate lines;

a gate driving circuit to apply a plurality of gate signals to the gate lines, respectively;

a data driving circuit to apply a plurality of data voltages to the data lines, respectively; and a storage driving circuit comprising a plurality of stages to apply a plurality of storage voltages, which are inverted in every frame, to the storage lines, respectively, a $k^{th}$ stage of the stages comprising:

a counter charging part to apply a first driving voltage to a $k^{th}$ storage line based on a $k^{th}$ gate signal;

a boosting part to apply a second driving voltage to the $k^{th}$ storage line based on a $(k+2)^{th}$ gate signal; and a holding part to apply a storage voltage to the $k^{th}$ storage line based on a $(k+1)^{th}$ gate signal during one frame, the level of the storage voltage corresponding to the second driving voltage, wherein 'k' is a natural number, wherein the data voltage is inverted in every row of a plurality of pixel parts and in every frame, wherein the first driving voltage and the second driving voltage are inverted in every frame, and wherein the holding part comprises:

a first switching element to output a first switching voltage based on the $(k+1)^{th}$ gate signal;

a second switching element to output a second switching voltage based on the $(k+1)^{th}$ gate signal;

a third switching element to output a first storage voltage to the $k^{th}$ storage line based on the first switching voltage;

a fourth switching element to output a second storage voltage to the $k^{th}$ storage line based on the second switching voltage;

a first capacitor to be charged with the first switching voltage to maintain an on/off state of the third switching element during the one frame; and a second capacitor to be charged with the second switching voltage to maintain an on/off state of the fourth switching element during the one frame.

6. The display device of claim 5, wherein each of the first storage voltage and the second storage voltage is a constant voltage.

7. The display device of claim 6, wherein the first switching voltage and the second switching voltage are inverted in every frame.

8. The display device of claim 7, wherein the data voltage has positive polarity, the second driving voltage and the first driving voltage have a first level and a second level opposite the first level, respectively, the first storage voltage and the second storage voltage have the first level and the second level, respectively, and the first switching voltage and the second switching voltage have a turn-on level and a turn-off level opposite to the turn-on level.

9. The display device of claim 5, wherein a ratio of width/length of a channel region of each of the third switching element and the fourth switching element is no more than about one-tenth of that of the channel region of a switching transistor of each of the counter charging part and the boosting part.

10. The display device of claim 5, wherein the storage driving circuit comprises:

a first voltage line and a second voltage line to receive the first driving voltage and the second driving voltage, respectively;

a first storage line and a second storage line to receive the first storage voltage and the second storage voltage, respectively; and a first switching line and a second switching line to receive the first switching voltage and the second switching voltage, respectively.

11. A storage driving circuit integrated on a display panel, comprising:

a plurality of gate lines to receive a plurality of gate signals;

a plurality of data lines; and a plurality of storage lines extending in a direction substantially parallel to the gate lines, the storage lines comprising a plurality of stages to apply a plurality of storage voltages, which are inverted in every frame, to the storage lines, respectively, a $k^{th}$ stage of the stages comprising:

a first voltage application unit to apply a first driving voltage to a $k^{th}$ storage line based on a $k^{th}$ signal;

a second voltage application unit to apply a second driving voltage to the $k^{th}$ storage line based on a $(k+2)^{th}$ gate signal; and a third voltage application unit to apply a storage voltage to the $k^{th}$ storage line based on a $(k+1)^{th}$ gate signal, wherein 'k' is a natural number, wherein the third voltage application unit comprises:

a first switching element to output a first switching voltage based on the $(k+1)^{th}$ gate signal;

a second switching element to output a second switching voltage based on the $(k+1)^{th}$ gate signal;

a third switching element to output a first storage voltage to the $k^{th}$ storage line based on the first switching voltage;

a fourth switching element to output a second storage voltage to the $k^{th}$ storage line based on the second switching voltage;

a first capacitor to be charged with the fist switching voltage to maintain an on/off state of the third switching element during the one frame; and a second capacitor to be charged with the second switching voltage to maintain an on/off state of the fourth switching element during the one frame.

12. The storage driving circuit of claim 11, wherein the level of the storage voltage corresponds to the second driving voltage.

13. A storage driving circuit integrated on a display panel, comprising:

a plurality of gate lines to receive a plurality of gate signals;

a plurality of data lines; and a plurality of storage lines extending in a direction substantially parallel to the gate lines, the storage lines comprising a plurality of stages to apply a plurality of storage voltages, which are inverted in every frame, to the storage liens, respectively, a $k^{th}$ stage of the stages comprising:

a counter charging part to apply a first driving voltage to a $k^{th}$ storage line based on a $k^{th}$ gate signal:

a boosting part to apply a second driving voltage to the $k^{th}$ storage line based on a $(k+2)^{th}$ gate signal; and a holding part to apply a storage voltage to the $k^{th}$ storage line based on a $(k+1)^{th}$ gate signal during one frame, the level of the storage voltage corresponding to the second driving voltage, wherein 'k' is a natural number, wherein the first driving voltage and the second driving voltage are inverted in every frame, and wherein the holding part comprises:

a first switching element to output a first switching voltage based on the $(k+1)^{th}$ gate signal;

a second switching element to output a second switching voltage based on the $(k+1)^{th}$ gate signal;

a third switching element to output a first storage voltage to the $k^{th}$ storage line based on the first switching voltage;

a fourth switching element to output a second storage voltage to the $k^{th}$ storage line based on the second switching voltage;

a first capacitor to be charged with the first switching voltage to maintain an on/off state of the third switching element during the one frame; and a second capacitor to be charged with the second switching voltage to maintain an on/off state of the fourth switching element during the one frame.

14. The storage driving circuit of claim 13, wherein each of the first storage voltage and the second storage voltage is a constant voltage.

15. The storage driving circuit of claim 14, wherein the first switching voltage and the second switching voltage are inverted in every frame.

16. The storage driving circuit of claim 15, wherein the data voltage has positive polarity, the second driving voltage and the first driving voltage have a first level and a second level opposite to the first level, respectively, the first storage voltage and the second storage voltage have the first level and the second level, respectively, and the first switching voltage and the second switching voltage have a turn-on level and a turn-off level opposite to the turn-on level.

17. The storage driving circuit of claim 13, wherein a ratio of width/length of a channel region of each of the third switching element and the fourth switching element is no more than about one-tenth of that of the channel region of a switching transistor of each of the counter charging part and the boosting part.

18. The storage driving circuit of claim 13, further comprising:

a first voltage line and a second voltage line to receive the first driving voltage and the second driving voltage, respectively;

a first storage line and a second storage line to receive the first storage voltage and the second storage voltage, respectively; and a first switching line and a second switching line to receive the first switching voltage and the second switching voltage, respectively.

* * * * *